US005303860A

United States Patent [19]

Serafini, Jr.

[11] Patent Number: 5,303,860

[45] Date of Patent: Apr. 19, 1994

[54] GUN HOLSTER ASSEMBLY

[76] Inventor: Frank V. Serafini, Jr., 8303 Coquina Ave., Fort Pierce, Fla. 34951

[21] Appl. No.: 8,151

[22] Filed: Jan. 25, 1993

[51] Int. Cl.[5] ..... F41C 33/02

[52] U.S. Cl. ..... 224/238; 224/19; 224/198; 224/253; 224/912; 224/911; 224/904; 220/324

[58] Field of Search ..... 224/914, 911, 912, 904, 224/192, 193, 198, 225, 226, 235, 236, 238, 239, 240, 241, 243, 253; 220/324, 318, 315

[56] References Cited

U.S. PATENT DOCUMENTS

| | | | |
|---|---|---|---|
| 38,213 | 4/1863 | Bennett | 224/238 |
| 876,398 | 1/1908 | Roberts | 220/324 |
| 2,455,635 | 12/1948 | Wihe | 224/912 X |
| 3,664,560 | 5/1972 | Perkins | 224/914 X |
| 3,695,233 | 10/1972 | Kovarik | 220/324 |
| 3,942,691 | 3/1976 | Sisak | 224/275 |
| 4,218,000 | 8/1980 | Mixson | 224/911 |
| 4,591,081 | 5/1986 | Bianchi et al. | 224/192 |
| 4,757,894 | 7/1988 | Schreckenstein | 224/239 X |
| 5,108,019 | 4/1992 | Woodward | 224/243 |

*Primary Examiner*—Ernest G. Cusick
*Attorney, Agent, or Firm*—Leon Gilden

[57] ABSTRACT

A gun holster assembly includes a holster container having a lid to hermetically seal the holster to secure a pistol therewithin, and to further include a plurality of second containers arranged to receive an associated handcuff and pistol magazine respectively.

2 Claims, 4 Drawing Sheets

GUN HOLSTER ASSEMBLY

BACKGROUND OF THE INVENTION

1. Field of the Invention

The field of invention relates to pistol holster structure, and more particularly pertains to a new and improved gun holster assembly arranged to secure a gun and accessory structure.

2. Description of the Prior Art

Pistol holster structure of various types have been utilized throughout the prior art and exemplified in the U.S. Pat. Nos. 4,971,236; 4,787,540; 4,905,880; and 3,731,858.

Accordingly, the instant invention attempts to overcome deficiencies of the prior art by providing for a pistol holster and accessory container structure arranged to hermetically seal contents therewithin for security and protection afforded the components during storage and transport.

SUMMARY OF THE INVENTION

In view of the foregoing disadvantages inherent in the known types of pistol holster structure now present in the prior art, the present invention provides a gun holster assembly wherein the same is arranged to hermetically seal a gun and components in a sealed, secured relationship. As such, the general purpose of the present invention, which will be described subsequently in greater detail, is to provide a new and improved gun holster assembly which has all the advantages of the prior art gun and holster structure and none of the disadvantages.

To attain this, the present invention provides a gun holster including a holster container having a lid to hermetically seal the holster to secure a pistol therewithin, and to further include a plurality of second containers arranged to receive an associated handcuff and pistol magazine respectively.

My invention resides not in any one of these features per se, but rather in the particular combination of all of them herein disclosed and claimed and it is distinguished form the prior art in this particular combination of all of its structures for the functions specified.

There has thus been outlined, rather broadly, the more important features of the invention in order to the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art of who are not familiar with patent or legal terms or phraseology, to determined quickly from a cursory inspection the nature and essence of the technical disclosure of the application. The abstract is neither intended to define the invention of the application, which is measured by the claims, not is it intended to be limiting as to the scope of the invention in any way.

It is therefore an object of the present invention to provide a new and improved gun holster assembly which has all the advantages of the prior art gun and holster structure and none of the disadvantages.

It is another object of the present invention to provide a new and improved gun holster assembly which may be easily and efficiently manufactured and marketed.

It is further object of the present invention to provide a new and improved gun holster assembly which is of a durable and reliable construction.

An even further object of the present invention is to provide a new and improved gun holster assembly which is susceptible of a low cost of manufacture with regard to both materials and labor, and which accordingly is then susceptible of low prices of sale to the consuming public, thereby making such gun holster assemblies economically available to the buying public.

Still yet another object of the present invention is to provide a new and improve gun holster assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
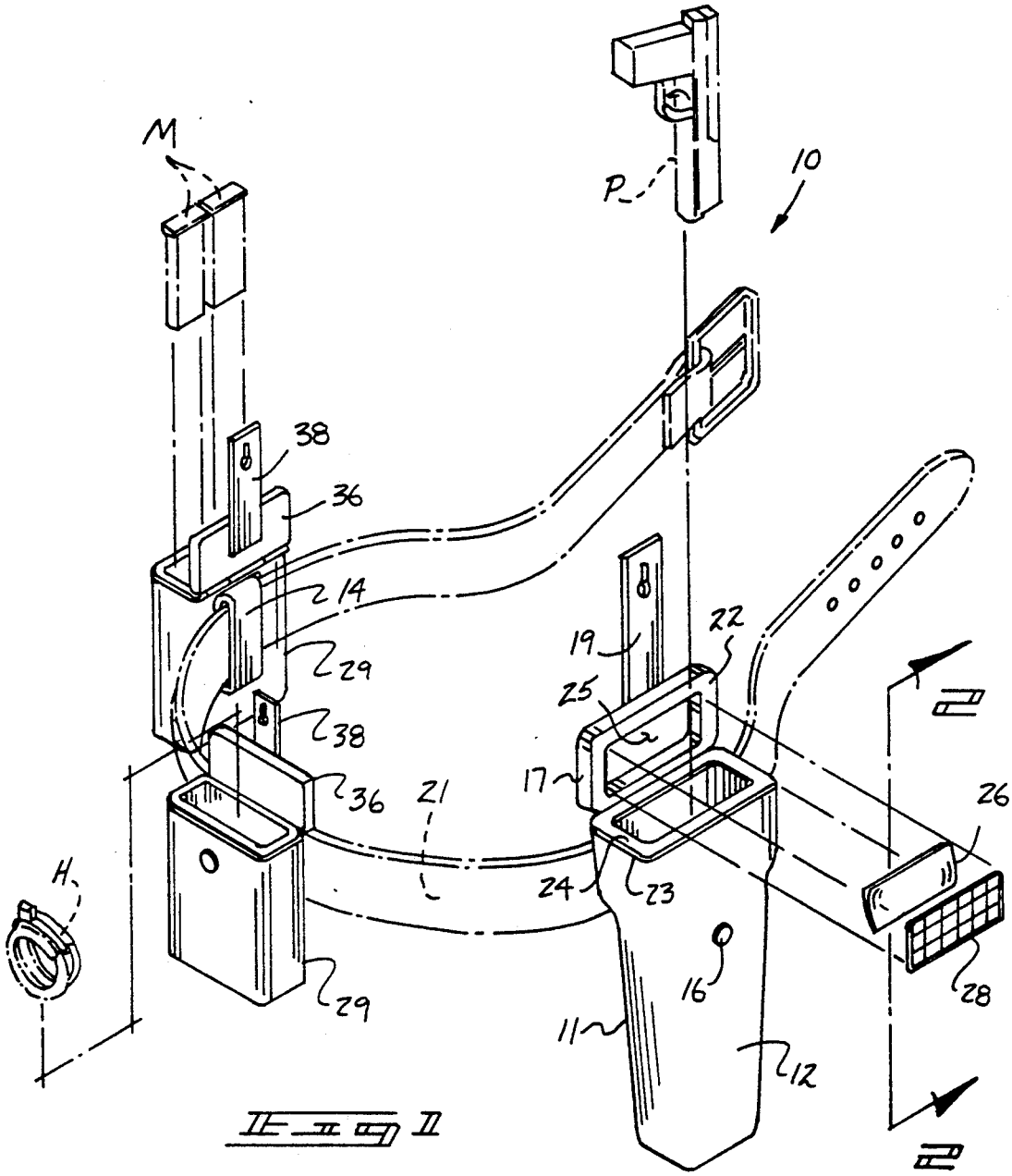
FIG. 1 is an isometric illustration of the invention.

With reference now to the drawings, and in particular to FIGS. 1 to 8 thereof, a new and improved gun holster assembly embodying the principles and concepts of the present invention and generally designated by the reference numeral 10 will be described.

Figure 2:
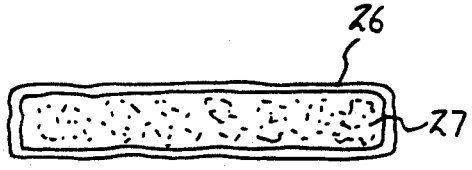
FIG. 2 is an orthographic view, taken along the lines 2—2 of FIG. 1 in the direction indicated by the arrows.
Figure 3:
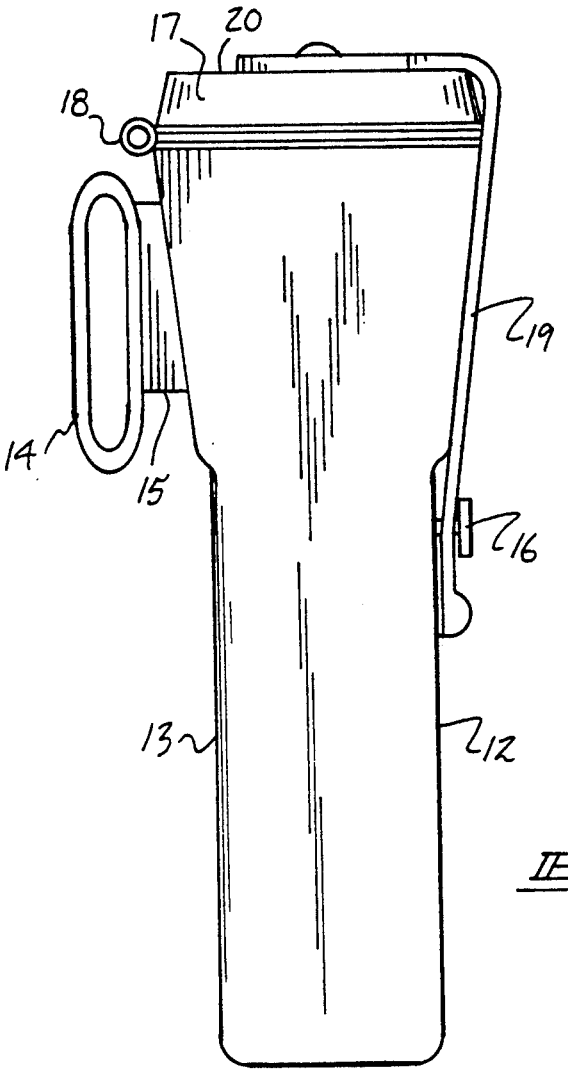
FIG. 3 is an orthographic side view of the gun holster container.
Figure 4:
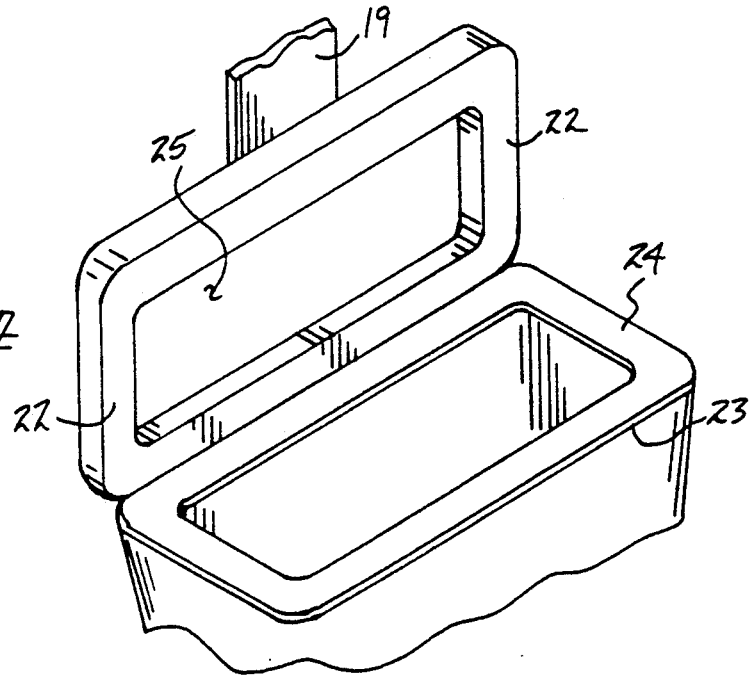
FIG. 4 is an isometric illustration of the gun holster arranged in an opened orientation.
Figure 5:
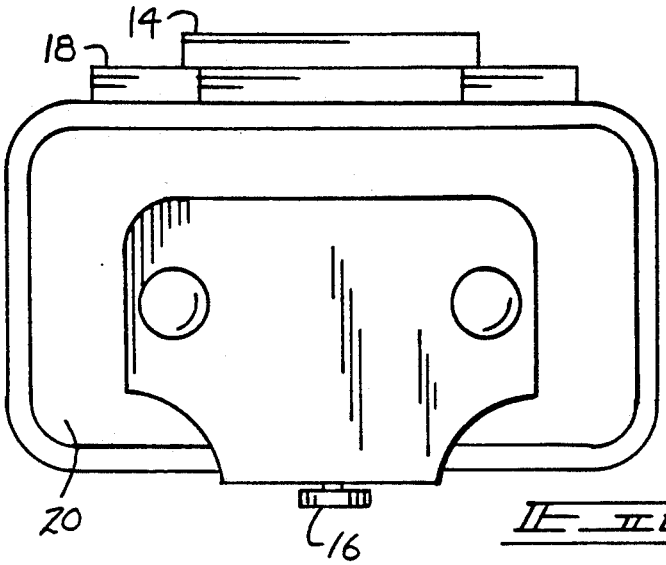
FIG. 5 is an orthographic top view of the gun holster.
Figure 6:
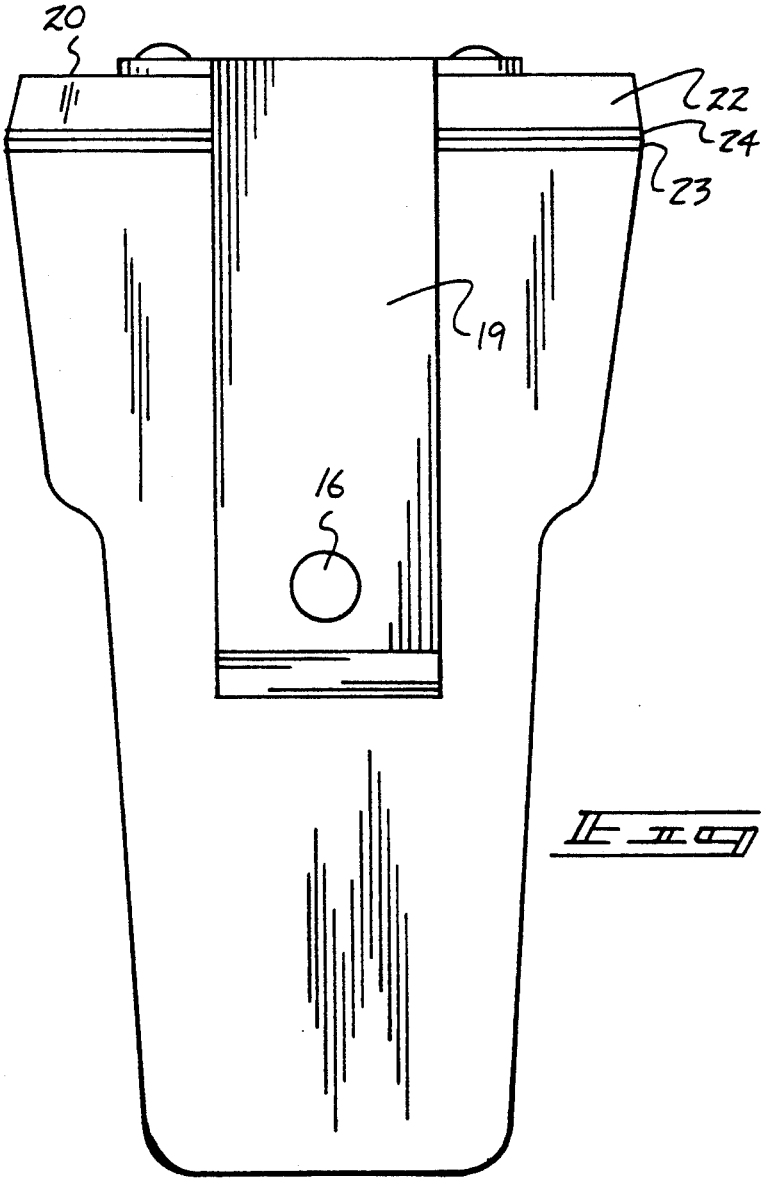
FIG. 6 is an orthographic front view of the gun holster.

More specifically, the gun holster assembly 10 of the instant invention includes a rigid pistol holster first housing 11, having a first housing front wall 12 spaced from a first housing rear wall 13. A first housing support loop 14 extends from the first housing rear wall 13, to include a rigid support loop boss 15 fixedly mounted intermediate the support loop 14 and the rear wall 13. A front wall lug 16 is mounted to the front wall. A first housing lid 17, including a first housing lid hinge 18 extending between the first housing lid 17 and the first housing rear wall 13, pivotally mounts the first housing lid 17 relative to the first housing 11. An elastomeric first strap 19 is mounted to the first lid top wall 20 for securement to the front wall lug 16 through an aperture directed into the first strap 19. The first housing 11, as well as a plurality of second rigid containers 29, are secured to an elongate flexible support strap 21 for securement about an individual's torso portion in use. A pistol "P" is directed into the first housing 11 and to hermetically and sealingly secure the pistol "P" therewithin, a lid lower perimeter wall 22 is spaced from the first lid top wall 20 defining a first lid cavity 25. A first housing perimeter top wall 23 includes a continuous resilient elastomeric gasket 24 mounted thereon for engagement with the lid lower perimeter wall 22, whereupon securement of the strap 19 to the lug 16 effects a hermetic sealing of the pistol "P" within the first container 11. An anhydrous desiccant container 26, having a desiccant powder 27 contained therewithin, as illustrated in FIG. 2, is received within the cavity 25. The cavity 25 within the lid lower perimeter wall 22 defines a predetermined configuration, wherein a screen grid 28 having said predetermined configuration is frictionally received in engagement within the cavity 25 in a spaced relationship relative to the top wall 20 to secure the desiccant container 26 within the cavity 25 to insure removal of moisture from within the first housing 11 when the lid 17 is in sealing engagement with the first housing 11.

Figure 7:
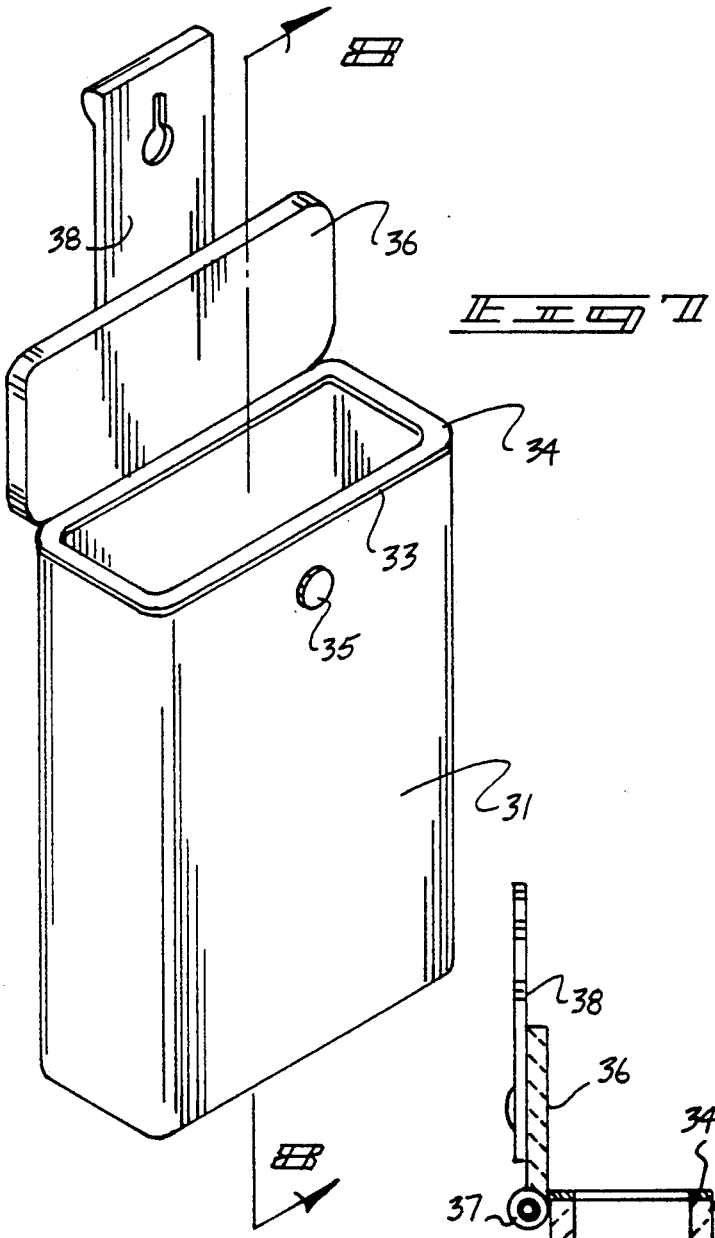
FIG. 7 is an isometric illustration of a second container structure.
Figure 8:
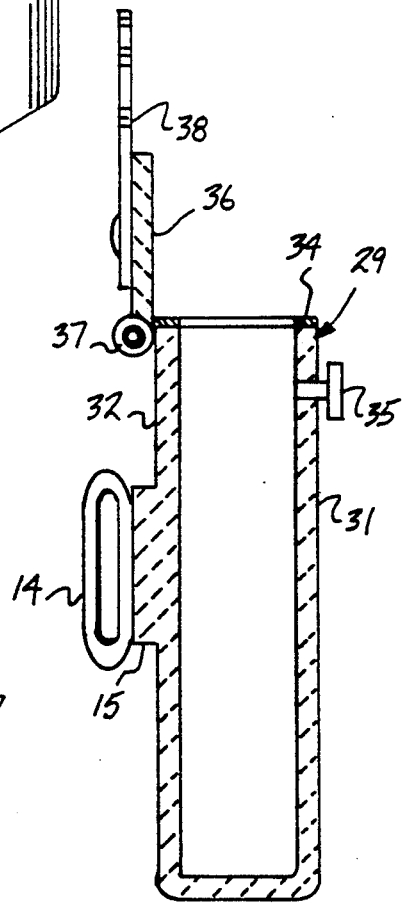
FIG. 8 is an orthographic view, taken along the lines 8—8 of FIG. 7 in the direction indicated by the arrows.

As illustrated in the FIGS. 1, 7, and 8, a plurality of second rigid containers 29 are provided, each having a second container front wall 31 and a second container rear wall 32, with each rear wall 32 including the rigid support boss 15 mounting a support loop 14 for receiving the support strap 21 through the loops. The second container includes second container top wall 33, having a second container resilient gasket 34 coextensively mounted to the second container top wall 33. A second container front wall lug 35 is mounted to the second container front wall 31, wherein a second container rigid lid 36 is hingedly mounted about a second container hinge 37 adjacent the second container rear wall 32. A second elastomeric strap 38 mounted to a second container rigid lid top wall extends from the lid 36 in securement to the second container top wall lug 35. The second containers includes reception and securement of handcuffs "H" and pistol magazines "M" therewithin.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gun holster assembly, comprising, a flexible support strap, and a rigid first housing, a first housing having a first housing front wall spaced from a first housing rear wall, and a first rigid boss mounted to the rear wall, and a first flexible loop mounted to the rigid boss spaced from the first housing rear wall, and a rigid first housing lid, the first housing lid including a first hinge, the hinge secured to the first lid in adjacency to the first housing rear wall, and the first housing front wall including a first lug, and an elastomeric first strap mounted to the first housing lid for securement to the first housing front wall lug, and the first housing lid includes a first lid top wall, wherein the elastomeric first strap includes a first strap first end secured to the first lid top wall, and a first strap second end extending to the first housing front wall, and the first housing lid includes a lid lower perimeter wall, the first housing includes a first housing top wall, wherein the lid lower perimeter wall includes a continuous predetermined configuration, and the first housing top wall is oriented as said predetermined configuration for contiguous and coextensive communication with the lid lower perimeter wall, wherein the first housing lid is in engagement with the first housing top wall, and a continuous, resilient elastomeric gasket mounted coextensively to the first housing top wall for sealing engagement with the lid lower perimeter wall, and the lid lower perimeter wall is spaced from the first lid top wall, with a first lid cavity positioned within the first lid between the lid lower perimeter wall and the first lid top wall, and an anhydrous desiccant container positioned within the first lid cavity containing a powdered desiccant therewithin, and a screen grid frictionally positioned within said first lid cavity in adjacency to the lid lower perimeter wall.

2. A gun holster assembly as set forth in claim 1 including a plurality of second containers, each of said second containers includes a second container front wall and a second container rear wall, and a second container continuous top wall, with a second container resilient gasket mounted coextensively with the second container top wall, and each second container further including a second container front wall lug mounted to the front wall, and each second container including a second container rigid lid, with each second container rigid lid having a second hinged mounted to the second container lid to each respective second container rear wall, and a second elastomeric strap extending from each respective rigid lid to each respective second container front wall lug.

* * * * *